United States Patent [19]

Ghiardo

[11] Patent Number: 4,936,356

[45] Date of Patent: Jun. 26, 1990

[54] ADJUSTMENT OF MOTOR SPEED IN YARN FEEDERS ACCORDING TO YARN RESERVE

[75] Inventor: Fiorenzo Ghiardo, Vigliano Biellese, Italy

[73] Assignee: Roj Electrotex S.p.A., Biella, Italy

[21] Appl. No.: 308,665

[22] Filed: Feb. 10, 1989

[30] Foreign Application Priority Data

Feb. 11, 1988 [IT] Italy ..... 19378 A/88

[51] Int. Cl.[5] ..... D03D 47/34

[52] U.S. Cl. ..... 139/452

[58] Field of Search ..... 139/452; 242/47.01

[56] References Cited

U.S. PATENT DOCUMENTS 4,226,379 10/1980 Brouwer et al. .
4,715,411 12/1987 Van Bogaert et al. ..... 139/452
4,799,517 1/1989 Bucher ..... 139/452
4,811,762 3/1989 Bucher et al. ..... 242/47.1 X

FOREIGN PATENT DOCUMENTS 0094099 11/1983 European Pat. Off. .
0164032 12/1985 European Pat. Off. .
0171516 2/1986 European Pat. Off. .
0174039 3/1986 European Pat. Off. .
0192851 9/1986 European Pat. Off. .
0253760 1/1988 European Pat. Off. .
3123760 2/1982 Fed. Rep. of Germany .

*Primary Examiner*—Andrew M. Falik
*Attorney, Agent, or Firm*—Young & Thompson

[57] ABSTRACT

A method and apparatus to adjust the motor speed in yarn feeders for textile machines and, in particular, weft feeders for weaving looms, wherein a yarn reserve is wound on a rotary drum held stationary, by a winding arm rotated by the motor. Photoelectric cells positioned close to a yarn outlet end of the drum emit signals which adjust—in cooperation with detection of the rotations of the winding arm—the motor speed of the feeder. These signals differ from each other according to whether an advancing turn of the yarn reserve intercepts a luminous beam for a relatively long period of time or whether yarn drawn from the reserve by the loom intercepts a luminous beam for a relatively short period of time. These signals are discriminated so as to adjust said speed, so as to guarantee the constant presence of an adequate yarn reserve on the drum.

9 Claims, 5 Drawing Sheets

ADJUSTMENT OF MOTOR SPEED IN YARN FEEDERS ACCORDING TO YARN RESERVE

BACKGROUND OF THE INVENTION

The present invention concerns improvements in yarn feeders for textile machines and, in particular, in weft feeders for weaving looms, of the type in which the rotary drum on which the yarn is wound to form a reserve is held stationary and the turns of the yarn reserve are wound thereon by a rotary winding arm and are moved forward, mutually spaced, by suitable means.

As is known, in these machines, the yarn wound on the drum—properly positioned and with a practically constant tension—forms a yarn reserve for the textile machine to be fed. Particularly in the case of weaving looms, it forms a weft reserve for the loom, which can draw it so as to insert it into the warp quite independently from the ways and means adopted for its winding on the drum.

This hence requires an efficient and continuous control of the amount of yarn reserve on the drum, which has to be automatically kept substantially constant, with the least possible variations of the rotation speed of the rotary winding arm, that is, of the weft feeder motor.

For the control of the yarn reserve with mutually spaced turns, there are already known to be (for example from the DE-A-2934024) electromechanical means positioned externally to the drum and essentially consisting of one or more feeling rods, the position of which depends on the presence or the absence of yarn reserve turns in the drum area under control.

The position of the feeling rods causes in turn the operation of a transducer which generates an electric signal indicating the presence or the absence of yarn reserve.

It is also already known to use two electromechanical feelers, signaling a minimum and a maximum yarn reserve, with which there is associated an electronic circuit which processes the two signals and controls the winding speed of the reserve, so as to keep it as far as possible within the minimum and maximum limits.

There are also known to be (for example from the EP-A2-171516) other electromechanical means of the same type, the position of which again depends on the presence or the absence of yarn reserve, but which are positioned inside the drum and not externally thereto. These means are associated with a transducer, external to the drum, so as to be able to control, as in the previous cases, the winding of the yarn turns.

All such means detect the presence of weft yarn by contacting the yarn turns, thereby failing to satisfy, at least partly, the primary object of each weft feeder which is to put at the disposal of the loom, having to draw them, a plurality of reserve turns evenly arranged and wound with the slightest possible tension.

In fact, when working with fine and thus particularly delicate yarns, the mere contact with any one of the aforecited electromechanical devices may be sufficient to cause, from time to time, irregularities in the positioning of the turns, with consequent breakage when the reserve is being drawn by the loom.

Furthermore, in order to enable the turns to resist the pressure of the mechanical feeler, it may be necessary to brake the incoming yarn so as to obtain a more highly tensioned winding, thereby stressing the yarn even further and possibly breaking it.

On the other hand, if the pressure of the mechanical feeler on the yarn turns is reduced below a certain value the problem arises of the inevitable presence of dust produced by the yarn itself, which will soon strongly limit or even prevent the freedom of movement of said feeler.

To avoid all these problems invariably caused by the use of electromechanical means to control the yarn reserve, which means detect the presence of the turns by feeling them, use can be made—as is already done in practice—of photoelectric devices, which detect the presence of the turns by causing the same to intercept suitable light beams.

Such devices, when operating on weft feeders with mutually spaced turns of yarn reserve, may however easily supply wrong information in that, if they are not very sensitive, they are not adapted to distinguish between the presence and the absence of single yarn turns, whereas, if they are sensitive enough to detect single yarns, they are not in a position to distinguish between the presence of a turn of the reserve and the passage of a yarn leaving the weft feeder, drawn by the loom.

This drawback can be eliminated by making sure that the spaces between the turns of the reserve are not too wide, since in this case, while the reserve interferes with the light beams from the photoelectric means as a surface, the yarn leaving the weft feeder drawn by the loom interferes therewith as a line. It is thus easy to obtain different signals in the two cases, with a suitable sensitivity of the photoelectric means, and to hence control the motor of the weft feeder only with those signals generated by the presence of the reserve.

Solutions of this type are already known in the art.

For example, according to the EP-A-164032, the yarn turns are drawn close in the area of control on the drum, practically contacting each other in the case of working with thick yarns.

This solution limits however the possibility to select a space (pitch) of any width between the reserve turns, and to keep it unvaried along the whole winding drum, as can besides be required in the case of working "flat yarns", in order to prevent them from overlapping, or fluffy yarns, in order to prevent the fluff of two adjacent turns from interweaving, thereby causing breakage of the yarn while it is being drawn by the loom.

Furthermore, with this system, the even considerable differences in the dimensions of the yarns are adapted to create further elements of doubt as far as detecting the reserve by the photoelectric means. This occurs in particular with thick yarns.

This solution requires moreover a very efficient self-controlling system of the photoelectric devices, as one has to take into account the dust deposits which rapidly form on the lenses of the photoelectric cells. This creates difficulties of construction and problems which cannot always be satisfactorily solved in order to combine efficiency and economical advantages.

SUMMARY OF THE INVENTION

The present invention proposes to eliminate all the aforementioned drawbacks of the known electromechanical and photoelectric systems for detecting the yarn reserve. For this purpose, it concerns improvements in weft feeders, with advancement of the turns evenly and distinctly spaced (the width of the space or pitch between the turns being chosen only according to the type of yarn being worked), so as to allow said turns to be wound in the best way, with no breakage or overlapping of turns. These improvements allow to controlling very reliably and in a relatively simple and economical way, the presence of yarn reserve on the drum by photoelectric means, and to adjust the operation of the weft feeder according to the data supplied by said means, thereby obtaining a very uniform speed of the winding arm.

More precisely, the invention concerns first of all a method to adjust the motor speed in yarn feeders for textile machines and, in particular, weft feeders for weaving looms, of the type wherein a yarn reserve, formed of evenly and distinctly spaced turns, is wound on a rotary drum held stationary by means of a winding arm caused to rotate by said motor, said yarn reserve being controlled by photoelectric means, positioned close to the yarn outlet end of said drum, which adjust—in cooperation with means detecting the rotations of the winding arm—the motor speed of the feeder, characterized in that, among the signals from said photoelectric means, those produced by the advancement of the yarn turns are discriminated, in an electronic circuit, from those produced by the passage of yarns drawn from said reserve by the loom, and in that, said second signals are used—in combination with the signal generated by the means detecting the rotations of the winding arm—to determine the speed of the motor, and said first signals are used to adjust said speed, so as to guarantee the constant presence of an adequate yarn reserve on the drum.

Preferably, two of said first signals are provided, corresponding to two distinct photoelectric means, one of said signals being adapted to adjust the speed of the motor so as to make sure that the end of the reserve, close to the yarn outlet end of the drum, always remains adjacent the area of said drum controlled by the corresponding photoelectric means, while the other signal promptly reduces said speed when said end of the reserve occupies the area of the drum controlled by the corresponding photoelectric means.

The invention also concerns a yarn feeder of the already defined type, characterized in that said photoelectric means comprise at least one photoelectric cell, adapted to detect the advance of the turns of the reserve as well as the passage of the yarns drawn from the drum by the loom, and an electronic circuit receiving the signals from said photoelectric cell and adapted to discriminate, among them, the signals produced by the advance of the turns of the reserve from the signals produced by the passage of yarns drawn from said reserve by the loom, and to use said second signals—in combination with the signal generated by the means detecting the rotations of the winding arm—to determine the motor speed of the feeder, and said first signals to adjust said speed.

Preferably, two of said photoelectric cells are provided, and two corresponding sections of the electronic circuit, respectively fed by the signals from said photoelectric cells, generate said first and second signals.

BRIEF DESCRIPTION OF THE DRAWINGS

The invention is now described in further detail, by mere way of example, with reference to the accompanying drawings, which show some preferred embodiments of the yarn feeder according to the invention, and in which.

DESCRIPTION OF THE PREFERRED EMBODIMENTS

Figure 1:
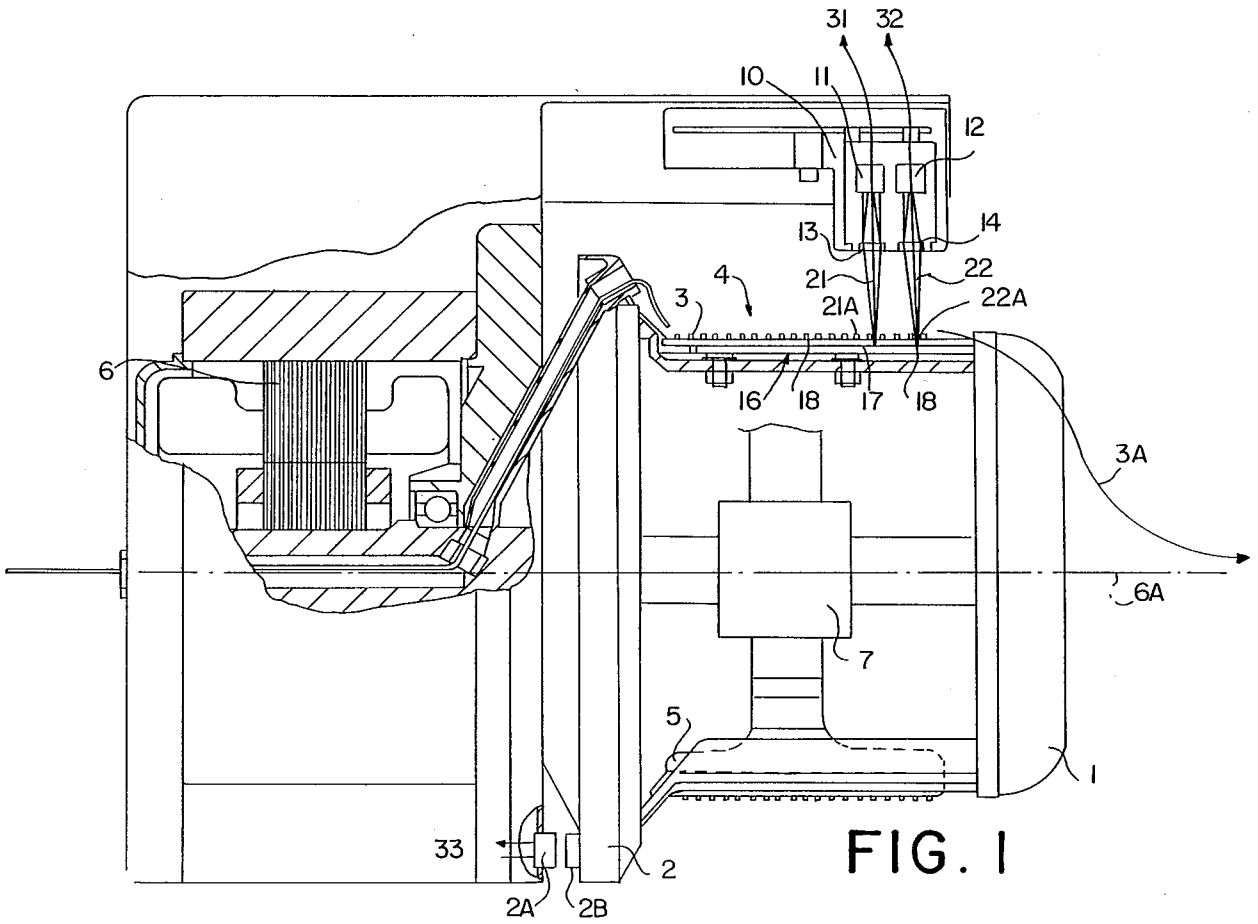
FIG. 1 diagrammatically illustrates a weft feeder equipped with photoelectric means to control the yarn reserve, according to the invention, said means comprising two photoelectric cells acting with beams in parallel through different lenses.

With reference to FIG. 1 of the drawings, in a weft feeder of the type having a drum 1 held stationary, a rotary winding arm 2 winds turns of weft yarn 3 on said drum 1 to form a reserve 4. Reference 3A indicates the weft yarn leaving the drum 1 of the weft feeder and being drawn by the loom.

The advance of the turns 3 is effected, in known manner, through a plurality of movable columns 5, partially and variably emerging from the periphery of the drum 1 through suitable slots therein thanks to the particular motion imparted thereto by the motor 6 of the weft feeder, in respect of the axis 6A of which they are mounted eccentrically rotating by a support 7, comprising an inclined bush and a rolling bearing (not shown). The support 7 is mounted, in known manner, with the possibility to adjust the reciprocal position of the bush and of the eccentric, so as to vary the pitch of the reserve turns on the drum 1. The possibility to adjust the pitch of the yarn turns allows the operator to set the weft feeder in the most appropriate conditions to obtain, according to the type of yarn being worked, the best arrangement of the turns to avoid overlapping thereof. In fact, when working with flat yarns, the pitch of the turns should be at least equal to the width of the yarn; when working with fluffy yarns, the turns should be kept well spaced apart, so as to practically eliminate the chances that the fluff of adjacent turns may interweave; when working with normal and fine yarns, it is instead convenient to reduce the pitch of the turns, so as to be able to wind a larger reserve on the drum, particularly in order to avoid sudden and frequent accelerations and decelerations of the weft feeder motor, when working with fabrics with stripes of the same weft repeating themselves periodically (multicolor looms).

To control the yarn reserve in such an arrangement, use is made—according to the invention—of two photoelectric cells 11 and 12, mounted on the same support 10, facing laterally the drum 1 in proximity to its outlet end. In the embodiment illustrated in FIG. 1, the photoelectric cell 11 generates a luminous beam 21, while the photoelectric cell 12 generates a luminous beam 22, said beams being set side by side and being focused by two lenses 13 and 14 which concentrate them in distinct points 21A, 22A, on a reflecting element 16 disposed at the periphery of the drum 1, close to the yarn outlet end.

Figure 2:
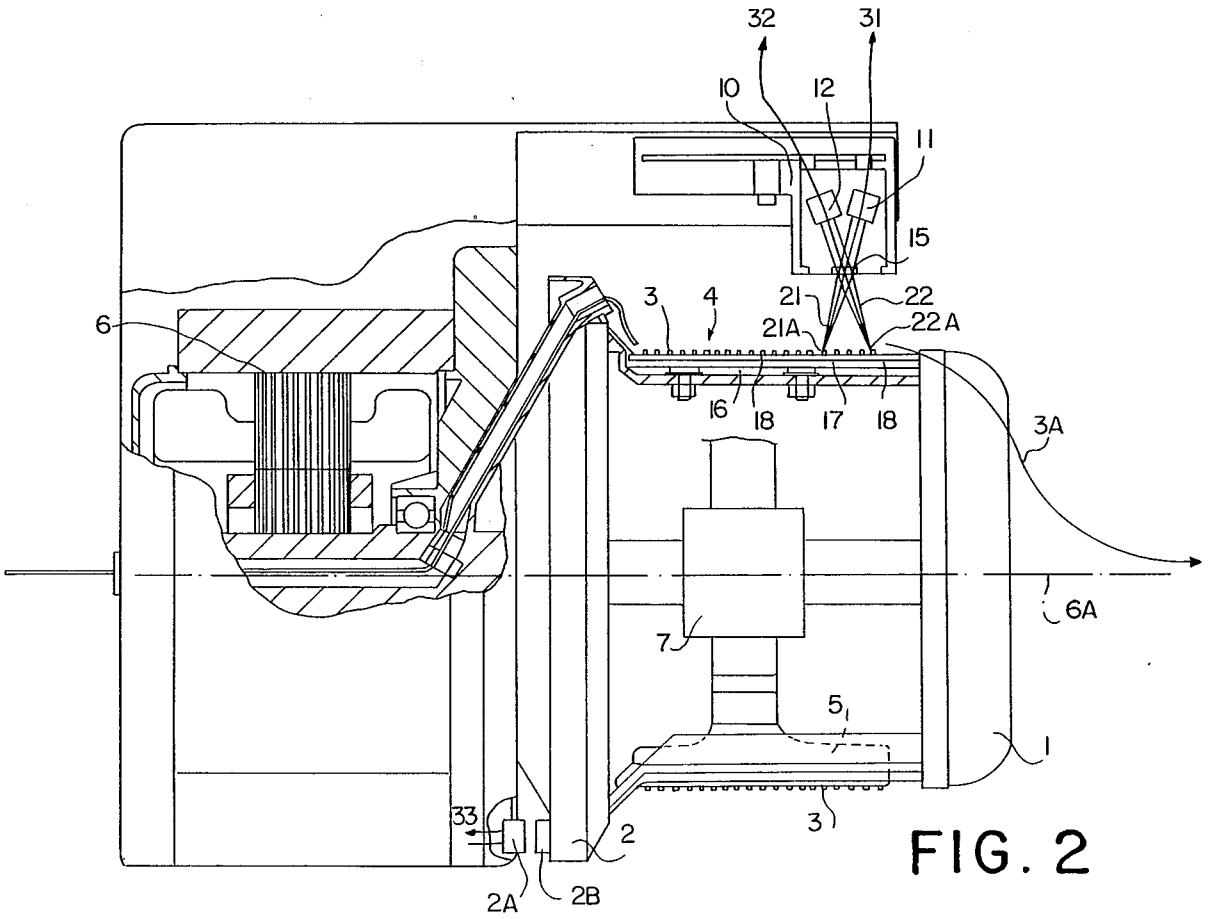
FIG. 2 shows a different embodiment of the control means of FIG. 1, said photoelectric means comprising two photoelectric cells acting with cross beams through a common lens.
Figure 3:
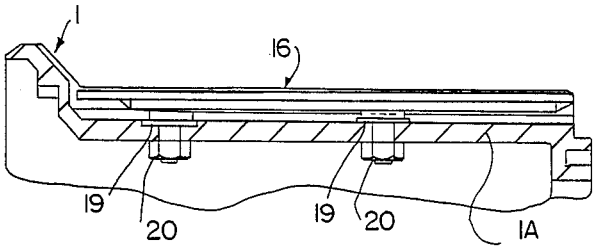
FIG. 3 to 6 show in detail, on an enlarged scale, the mounting on the weft feeder drum of FIGS. 1 and 2 of the reflecting element of the photoelectric means according to the invention, two different possibilities of adjusting the position of said element being illustrated.
Figure 4:
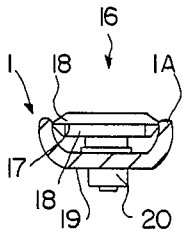
Figure 5:
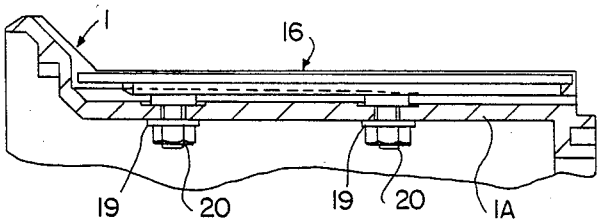
Figure 6:
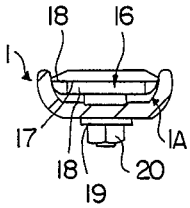

In the embodiment of FIG. 2, the luminous beams from the photoelectric cells 11 and 12 cross each other adjacent to the cover glass where a single lens 15 converges them on distinct points 21A, 22A, of the reflecting element 16. This reflecting element is preferably formed—in both embodiments of FIGS. 1 and 2—of a strip of reflector tape 17 interposed between two glass strips 18 parallel to the axis of the drum 1.

As is shown in more detail in FIGS. 3 to 6, the reflecting element 16 is mounted on the drum 1, with the possibility either to slightly project from its periphery (FIGS. 3 and 4), so that the turns 3, on moving forward, skim the surface of the outer glass strip 18 and free it as far as possible from dust, or to be kept slightly depressed in respect of the periphery of the drum 1 (FIGS. 5 and 6), in the event that the contact of the yarn with the outer glass strip 18 should instead be harmful for a perfect advance of the turns. For this purpose, it will be sufficient to shift the washers 19 of the locking bolts 20 from the external part (FIGS. 3 and 4) to the internal part (FIGS. 5 and 6) of the surface 1A of the drum 1, to which the reflecting element 16 is applied.

The beams of light which return from the reflecting element 16 to the photoelectric cells 11 and 12 generate, respectively, two signals 31 and 32 (FIGS. 1 and 2).

The invention is based, at least as to its main aspects, on the fact that the speeds at which the yarns effect their passages in the areas controlled by the photoelectric cells 11 and 12, are substantially different according to whether said passages are effected by the yarn turns being unwound (yarn drawn from the reserve on the drum by the loom), or by the yarn turns being wound on the drum to form a reserve.

Supposing the beam of light to be concentrated to form a luminous spot on the reflecting element 16, it has in fact been found that the yarn turns, when moving forward to form the reserve, produce, as they intersect the beam, a change in the light being reflected which generates an electric signal from the photoelectric cell; the length of said signal, depending on the motor rotation speed (as well as on the yarn diameter), is of an order of magnitude order between 2 and 100 milliseconds.

It has also been found that, when the yarn intersects the beam as it is being drawn by the loom, it instead generates much shorter signals, the length of which is of an order of magnitude order between 0.05 and 0.5 milliseconds.

According to the invention, the signals from the photoelectric cells are then sent to an electronic circuit adapted to discriminate, among them, those produced by the reserve turns advancing on the drum, from those produced by the yarn leaving the drum and being drawn by the loom, so that said signals can be properly used for adjusting the motor speed of the weft feeder.

Figure 7:
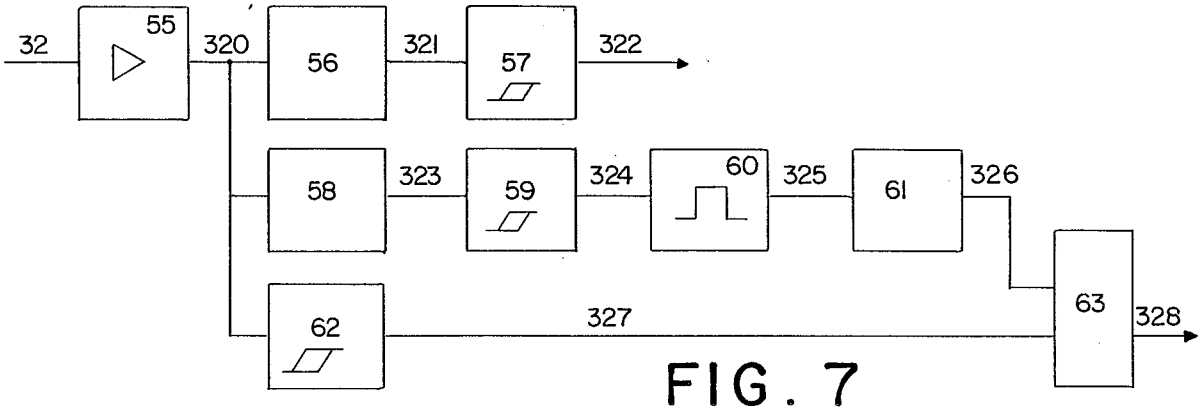
FIGS. 7 and 8 are block diagrams of the two electronic circuits processing the signals from the two photoelectric cells of the weft feeder according to the embodiment of the invention shown in FIGS. 1 and 2.
Figure 8:
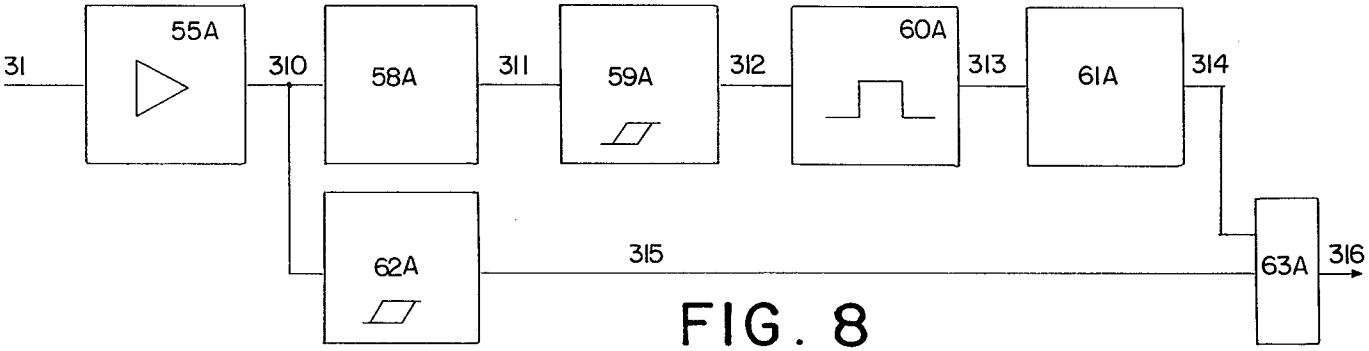

Comprising as in the two embodiments of the invention shown so far—two control photoelectric cells 11 and 12 (FIGS. 1 and 2), the aforespecified electronic circuit is provided, according to the invention, as shown in the block diagrams of FIGS. 7 and 8.

FIG. 7 is a block diagram of an electronic circuit to process the signal 32 generated by the photoelectric cell 12 of FIGS. 1 or 2.

In this circuit, the signal 32 is fed to a continuous amplifier 55 so as to be brought to a higher level (signal 320).

The signal 320 is fed to the high-pass filter 56, with a cut-off frequency of about 1000 Hz which generates, in turn, the signal 321. The signal 321 is then clipped by a comparator with hysteresis 57 to generate the signal 322; since only the higher frequency signals 32 may follow this path, due to the presence of the filter 56, the signals 322 cannot practically be anything but pulses, each indicating that one turn is being drawn from the drum.

These pulses are used to count the turns leaving the drum and the information, thus obtained and subsequently processed, helps to determine the approximate motor speed needed to keep a constant yarn reserve on the drum 1.

The signal 320 is further fed to a band-pass filter 58, with a lower cut-off frequency of about 5 Hz and an upper cut-off frequency of about 400 Hz. The signal 323 from the filter 58 is subsequently clipped by a comparator with hysteresis 59, from which the output signal 324 is then fed to the digital filter 60, which lets pass only pulses lasting more than at least 2 milliseconds approximately.

The successive block 61 is a retriggerable monostable device which generates pulses lasting about 100 ms.

One thus obtains a signal 326, which is active only when the beam 22 is intersected by one or more turns advancing on the drum: only these in fact generate a signal 32 with variations, the frequency of which shall be included among the values of the band-pass filter, thereby generating a signal 323 and a consequent signal 324.

The successive block 60 again stops the signals which are too short, and the block 61 prolongs the signals 325 leaving the block 60, so as to finally have an active, steady, output signal 326 when the reserve moves forward under the beam 22.

It may happen however that the yarn being worked is so thick, or that the operator has chosen such a short pitch of the turns, that these latter are no longer mutually spaced.

In this situation, of adjacent turns, there will no longer be a variation in the luminous flux of the beam 22, as it will be permanently interrupted by the presence of the advancing turns.

In this case, if there is a reserve under the beam 22, the signal 320 no longer undergoes any significant changes and is considerably reduced. One would hence no longer obtain a signal 326 indicating the presence of a reserve, although it actually exists. Nonetheless, in this case, the signal 327 generated by the block 62 (comparator with hysteresis), being itself fed by the signal 320, becomes active and thus indicates the presence of yarn under the beam 22.

The signals 326 and 327 are logically summed in the block 63, so that the presence of either of these signals energizes the signal 328 indicating the presence of a reserve under the beam 22.

It should be noted that, with mutually spaced turns, one is informed of the presence of a reserve under the beam 22 only with a moving reserve: hence, the signal 328 is considered valid only when the weft feeder motor is running above a minimum rotation speed.

FIG. 8 illustrates the block diagram of an electronic circuit to process the signal 31 from the photoelectric cell 11.

This circuit is similar to that of FIG. 7, but does not comprise the blocks 56 and 57. In said circuit, the signal 31 corresponding to the luminous beam 21 is fed to the amplifier 55A, from which it then branches off into the band-pass filter 58A and into the comparator with hysteresis 62A.

The output signal 311 from the filter 58A is fed to a comparator with hysteresis 59A, then (signal 312) fed to a digital filter 60A and (signal 313) to a retriggerable monostable device 61A; the signals 314 from 61A, and 315 from 62A, are in the end logically summed by the block 63A which gives the output signal 316; this is active, similarly to the signal 328, only when there is a reserve moving in correspondence of the beam 21, or even when the reserve is not moving but the turns are adjacent. Of course, also the signal 316 should be considered valid only when the winding arm is rotating (i.e. the weft feeder motor is running).

The arrangement according to the invention of course also comprises means for detecting the rotations of the winding arm 2, consisting of a sensor 2A positioned near the winding arm 2 and of an element 2B fixed on the winding arm 2 and adapted to energize the sensor 2A when passing by the same.

The sensor 2A can be a photoelectric, magnetic, or other type of device, capable—when combined with the element 2B fixed on the winding arm 2—of generating a pulse signal 33 at each passage of the element 2B in proximity to the sensor 2A and thus for each rotation of the winding arm 2 (and of the weft feeder motor causing its rotation).

The operation of the weft feeder and of the electronic circuits associated therewith and described heretofore, allowing carrying out the control method according to the invention, will now be briefly described.

As the device starts to operate, the motor 6 is caused to perform a few rotations and the signal 316 supplied by the circuit of FIG. 8 is examined: if said signal is active, it means that there is a yarn reserve under the luminous beam 21 from the cell 11; the motor is then stopped and one waits for the signal 322 from the output block 57 of the circuit of FIG. 7 to appear, which indicates that the loom has started to draw yarn from the weft feeder.

But if the signal 316 is not active, it means that there is no yarn reserve on the drum 1; the motor 6 is then operated at a predetermined speed so as to wind on the drum 1 the first reserve 4; one counts the pulses 33 and waits for the signal 316 to appear, which indicates that the reserve has been wound; the motor is then stopped and one waits, as previously, for the signal 322 to occur.

If the counting of the pulses 33 goes on for too long (and the number of counted pulses exceeds the number of turns which the drum 1 can house), without the signal 316 having been received, the motor has to be stopped since, evidently, the inlet yarn has broken or the spool is empty.

To start again the weft feeder, it will thus be necessary to insert the yarn and return the device of starting conditions, for instance by cutting off and turning on again the supply of electric energy.

Each pulse of the signal 322 is equivalent to one turn drawn from the drum by the loom. The pulses 322 are present only when the yarn reserve does not reach the beam 22 since, as seen, in this case the yarn 3A drawn by the loom evidently does not intersect the beam 22.

The pulses 322 are counted and the motor is operated at a speed proportional to the total T of the pulses.

The proportionality constant has to be chosen according to the number of missing turns for which the top speed will have to be reached.

As soon as the motor starts to rotate, one receives pulses 33 which have to be deducted from T to accordingly reduce the motor speed, so as to adapt the number of turns forming the reserve to the number of turns being drawn by the loom.

It may happen that the number of turns leaving the drum, detected by the photoelectric cell 12, is not exact: it is in fact possible that the turns being unwound too slowly from the weft feeder drum 1 may escape the count ("error in default"); this usually happens by correspondence with the initial and final steps of each weft insertion into the loom shed, or even during the step of weft exchange, at the center of the shed, between the weft conveying members, for example between the grippers of shuttleless gripper looms.

It may also happen that nonexistent turns are counted ("error by excess"), due to bits and fluffs of dust intercepting the beam from the photoelectric cell.

To take into account the "errors by default", the number of pulses 322 is increased by a certain percentage, only if the signal 316 is inactive (no reserve under the beam 21), adding for instance one pulse in every ten.

To take into account the "errors by excess", the number of pulses 322 is reduced by a certain percentage, only if the signal 316 is active (presence of reserve under the beam 21), eliminating for instance one pulse in every ten.

In this way, the reserve 4 will tend to oscillate around the luminous beam 21 (FIG. 1): in fact, when the reserve does not reach the beam 21, T is increased, thereby making sure that said reserve is restored (obviously if the correction factor of the error by default is sufficiently high). The reserve will thus again extend beyond the beam 21.

In this situation, in the presence of an "excess error", the reserve would continue to increase, whereby the correction by default is introduced until the reserve is again within the boundaries of the beam 21.

This process can easily be stabilized by counting, for sufficiently large number of pulses, the difference between the number of pulses 33 and the number of pulses 322, and consequently updating the correction factors of the errors through a suitable statistical processing.

When the loom stops drawing weft from the feeder, the value T reaches zero, with consequent stopping of the motor, and the pulses 322 are again awaited.

It may happen that, during deceleration, the reserve 4 may move also beyond the area of the drum 1 controlled by the photoelectric cell 12; this will generate the signal 328. In this case, T is at once set to zero, thereby effecting prompt deceleration of the motor 6; the pulses 322 are then again awaited.

During normal operation of the loom and, thus, of the weft feeder, the reserve 4 oscillates on the drum 1 around its area controlled by the photoelectric cell 11 and hit by the beam 21: if the signal 316 remains inactive for too long, it means that the inlet yarn has broken or that the spool supplying the weft feeder is empty; the motor is stopped and one waits for the device to start again.

In principle, it is possible to control the reserve 4 with only the photoelectric cell 12 and the electronic circuit of FIG. 7, obviously simplyfying the construction and reducing the cost, but also achieving less satisfactory performance. With a weft feeder simply equipped with the photoelectric cell 12, and thus also without the circuit of FIG. 8, the operation of the device and the control method slightly change.

On starting of the device, the motor 6 is caused to perform a few rotations and the signal 328 is examined: if it is active, it means that there is a yarn reserve up to the beam 22; the motor is stopped and one waits for pulses of the signal 322.

If the signal 328 is not active, it means that there is no yarn reserve on the drum; the motor is then operated at a predetermined speed—preferably not high, in order to prevent breakage on the spool—so as to form the first reserve; at the same time, one counts the pulses 33 and waits for the signal 328; when this signal appears, the motor is stopped and one waits for the pulses of the signal 322.

If the counting of the pulses 33 exceeds a predetermined number, higher than the number of turns which the drum can house, without the signal 328 having been received, the motor is stopped since, evidently, the inlet yarn has broken or the yarn feed spool is empty.

To start again the weft feeder, it will be necessary to insert the yarn into the feeder and return the device to its starting conditions, for instance by cutting off and turning on again the supply of electric energy.

Also in this case, to each pulse of the signal 322 there corresponds one turn drawn from the drum by the loom.

The pulses 322 are present only when the yarn reserve does not extend beyond the beam 22, in that the point where the yarn turn drawn by the loom separates from the surface of the drum 1 has to be upstream in respect of the area controlled by said beam in order to be detected.

The pulses 322 are now counted so as to operate the motor at a speed proportional to the total T thereof.

The proportionality constant is determined according to the number of missing turns for which the top speed has to be reached.

As soon as the motor starts to rotate, one receives pulses 33 which are deducted from T, consequently reducing the motor speed.

It may happen that one turn is unwound from the drum 1 without being detected by the photoelectric cell 12; this can take place when the turn slowly intersects the beam 22, that is, in correspondence of the initial and final steps of each weft insertion, and also in the intermediate weft insertion step in gripper looms, during weft exchange at the center of the loom shed.

To take such errors into account, the number of pulses 322 is increased by a certain percentage, adding for instance one pulse every ten, when the signal 328 is not active.

In this situation, the yarn reserve restored on the weft feeder drum is more abundant than the yarn being drawn by the loom, whereupon the signal 328 is awaited.

If within a certain time (for instance a few seconds) the signal 328 is not received, it means that the yarn has broken or the spool is empty; T is set to zero and the motor is stopped.

To start again, the weft feeder will have to be reset to its starting conditions after having inserted the yarn.

If the signal 328 is instead present, T is promptly reduced and consequently the motor speed, so as to prevent the reserve from extending beyond the yarn outlet end of the drum.

When T reaches zero, the cycle is started again, as already described.

This embodiment of the weft feeder has the advantage—as already indicated—of simpler structure and lower cost, as the device requires only one photoelectric cell and does not require the circuit of FIG. 8, the circuit of FIG. 7 being sufficient for its proper operation. It has however the defect of imparting to the motor 6 more frequent speed changes and thus a less continuous operation of the feeder, since each time the reserve 4 extends beyond the beam 22, it being no longer possible to know whether the yarn goes on being drawn, one has to promptly reduce the motor speed so that the reserve will again be all upstream of the beam 22.

Thus, while in the embodiment with two photoelectric cells only slight motor speed changes are required to obtain a continuous oscillation of the yarn reserve end towards the loom in correspondence of the beam 21 from the photoelectric cell 11, said reserve extending beyond the beam 22 from the photoelectric cell 12 only in special cases, in the embodiment with a single photoelectric cell—described heretofore—the oscillation of the yarn reserve end towards the loom can take place only in correspondence of the beam 22, but with frequent and prompt changes of the motor speed, which has to be slowed down when the reserve extends beyond said beam.

Both in the case of using the first and in the case of using the second of the two weft feeder embodiments according to the invention, the signal 33 can also be used to provide information on the position of the winding arm 2: in fact, the signal 33 becomes active only when the energizing element 2B is in the range of action of the sensor 2A. This information can be used to stop the winding arm 2 in a predetermined position: when any one of the previously stated conditions arises, corresponding to the requirement to stop the motor, this latter is caused to perform its last rotation at low speed and is stopped upon receipt of the signal 33: in this way, the weft feeder remains still with the winding arm 2 in a predetermined position. This characteristic can be used to facilitate the operations of insertion.

Figure 9:
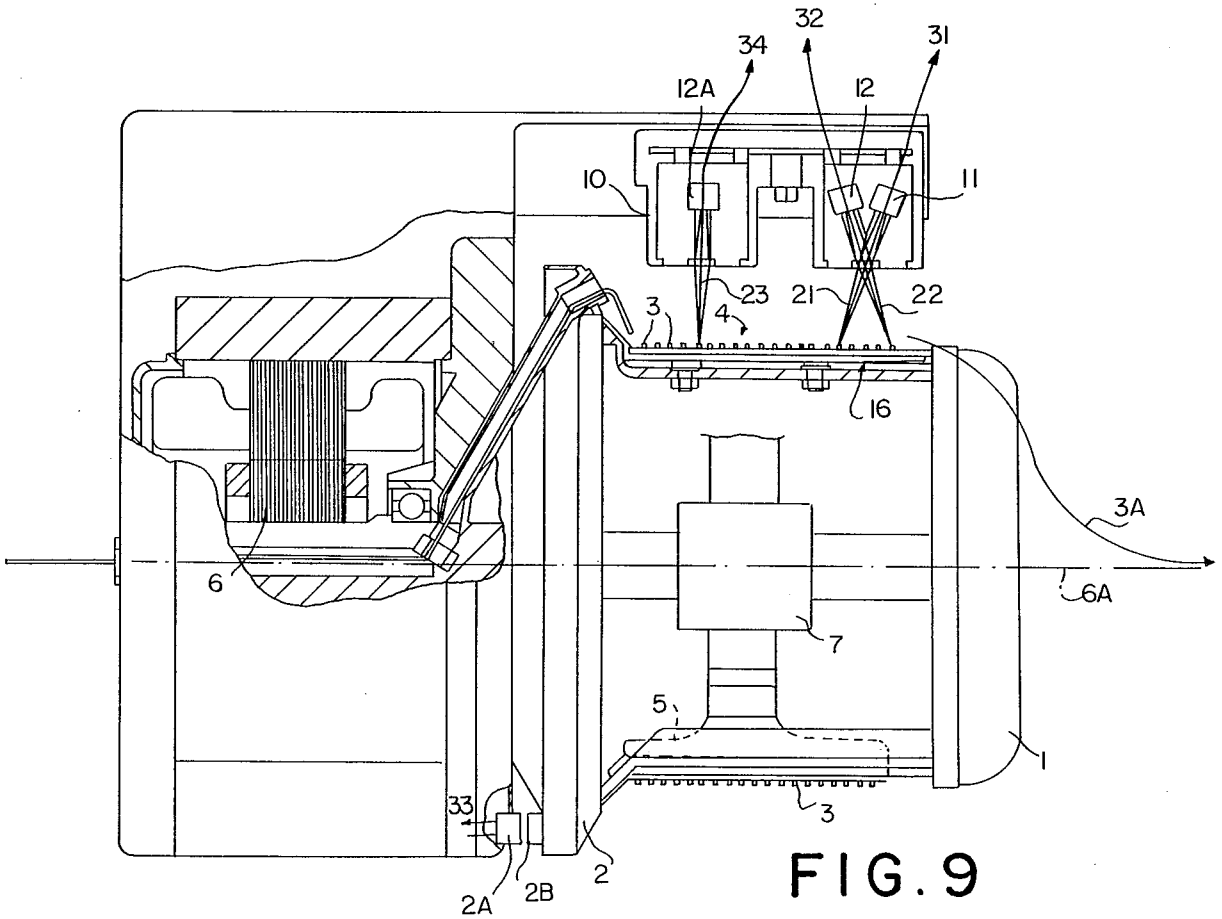
FIG. 9 shows an embodiment of the weft feeder according to the invention, similar to that of FIG. 2, but comprising further photoelectric means adapted to detect the absence of a yarn reserve on the yarn inlet area of the drum.

FIG. 9 illustrates a further embodiment of the weft feeder according to the invention, which uses three photoelectric cells 11, 12 and 12A. While the photoelectric cells 11 and 12 are positioned and used as in the case of the embodiment of FIG. 2, the photoelectric cell 12A is arranged so as to generate a beam 23 which hits the reflecting element 16 on the periphery of the drum 1 at a short distance from the winding arm 2, sufficient for winding a few turns 3 on the drum 1. The signal 34 generated by the beam 23 is processed by a circuit like that of FIG. 8 which processes the signal 31 from the photoelectric cell 11.

This allows detecting, while the device is working, the presence of a yarn reserve in correspondence of the beam 23: if there is no yarn reserve, it means that the inlet yarn is missing due to breaking thereof or to the spool being empty. At this point, the circuit of the weft feeder can promptly control the stopping of the loom before the reserve 4 wound on the drum 1 is exhausted, and thus before the broken end of the yarn being fed by the feeder is inserted into the shed. This third photoelectric cell 12A thus performs the function of controlling the presence of yarn supplied to the weft feeder and to send an alarm in case said yarn is missing.

It is to be understood that there may be other embodiments to carry out the method and the yarn feeder according to the invention, differing from those previously described and illustrated. In particular, it may be possible to vary the structural characteristics of the feeder and the type, components, and control method of the electronic circuits associated therewith, provided that they allow carrying out the adjustment method of the present invention.

I claim:

1. In a method to adjust the motor speed in yarn feeders for textile machines and, in particular, weft feeders for weaving looms, of the type wherein a yarn reserve, formed of evenly and distinctly spaced turns, is wound on a rotary drum held stationary, by means of a winding arm caused to rotate by said motor, said yarn reserve being controlled by photoelectric means emitting signals, positioned close to a yarn outlet end of said drum, which adjust—in cooperation with means detecting the rotations of the winding arm—the motor speed of the feeder; the improvement wherein said photoelectric means emit signals which differ from each other according to whether an advancing turn of the yarn reserve intercepts a luminous beam for a relatively long period of time or whether yarn drawn from the reserve by the loom intercepts a luminous beam for a relatively short period of time, discriminating among the signals from said photoelectric means (11, 12) those (316, 328) produced by the advance of the turns (3) of the yarn reserve (4), in an electronic circuit, from those (322) produced by the passage of yarns (3A) drawn from said reserve (4) by the loom, using the latter signals (322)—in combination with a signal (33) generated by the means detecting the rotations of the winding arm (2)—to determine the speed of the motor (6), and using the former signals (316, 328) to adjust said speed, so as to guarantee the constant presence of an adequate yarn reserve on the drum.

2. Method as in claim 1, further comprising the steps of providing two (316, 328) of said former signals, corresponding to two distinct photoelectric means adjacent the drum, one of said former signals (316) being adapted to adjust the speed of the motor (6) so as to make sure that the end of said reserve (4), close to the yarn outlet end of the drum (1), always remains adjacent the area of said drum controlled by the corresponding photoelectric means (11), and utilizing the other said former signal (328) promptly to reduce said speed when said end of the reserve (4) occupies the area of the drum (1) controlled by the corresponding photoelectric means (12).

3. Yarn feeder for textile machines, particularly weft feeder for weaving looms, of the type wherein a yarn reserve, formed of evenly and distinctly spaced turns, is wound on a rotary drum held stationary, by means of a winding arm caused to rotate by a motor, said yarn reserve being controlled by photoelectric means, positioned close to a yarn outlet end of said drum, which adjust—in cooperation with means detecting the rotations of the winding arm—the motor speed of the feeder, characterized in that said photoelectric means comprise at least one photoelectric cell (12) adjacent the drum, adapted to detect the advancement of the turns of the reserve (4) as well as the passage of the yarns (3A) drawn from the drum by the loom, and an electronic circuit receiving the signals (32) from said photoelectric cell (12) and adapted to discriminate, among them, signals (328) produced by the advancement of the turns (3) of the reserve (4) from signals (322) produced by the passage of yarns (3A) drawn from said reserve by the loom, and means to use the latter signals (322)—in combination with a signal (33) generated by the means (2A, 2B) detecting the rotations of the winding arm (2)—to determine the speed of the motor (6) of the feeder, and the former signals (328) to adjust said speed.

4. Yarn feeder as in claim 3, comprising two photoelectric cells (11, 12) and two corresponding sections of the electronic circuit, respectively fed by signals (21, 22) from said photoelectric cells to generate said former (316, 328) and latter (322) signals, said circuit using one (316) of said former signals to adjust the speed of the motor (6), so as to make sure that the end of the reserve (4), close to the yarn outlet end of the drum (1), always remains adjacent the area of said drum controlled by an adjacent photoelectric cell (11), and the other (328) of said first signals to promptly reduce said speed when said end of the reserve (4) occupies the area of the drum (1) controlled by another adjacent photoelectric cell (12).

5. Yarn feeder as in claim 4, wherein the beams (21, 22) from the photoelectric cells (11, 12) are reflected by a reflecting element (16) at the periphery of the drum (1), mounted on the feeder so that it can be adjusted to slightly project, or to alternatively be kept slightly depressed, in respect of the drum surface.

6. Yarn feeder as in claim 5, comprising a third photoelectric cell (12A) disposed close to the winding arm (2), adapted to detect the presence or the absence of a yarn reserve (4) on a yarn inlet area of the drum (1).

7. Yarn feeder as in claim 4, wherein a first section of the electronic circuit, fed by the signals (32) from the photoelectric cell (12) closest to the yarn outlet end of the drum (1), comprises an amplifier (55) feeding in parallel three branches including respectively: a high-pass filter (56) followed by a comparator with hysteresis (57) to generate said latter signals (322); a band-pass filter (58) followed by a comparator with hysteresis (59), by a digital filter (60) and by a retriggerable monostable device (61); and a comparator with hysteresis (62); and summing means (63) for logically summing up the signals (326, 327) supplied by the two last branches to generate said former signals (328).

8. Yarn feeder as in claim 4, wherein a second section of the electronic circuit, fed by the signals (31) from the photoelectric cell (11) farther from the yarn outlet end of the drum (1), comprises an amplifier (55A) feeding in parallel two branches including respectively: a band-pass filter (58A) followed by a comparator with hysteresis (59A), by a digital filter (60A) and by a retriggerable monostable device (61A); and a comparator with hysteresis (62A); signals (314, 315) supplied by said branches being logically summed up (in 63A) to generate said former signals (316).

9. Yarn feeder as in claim 3, comprising moreover further photoelectric means (12A) to detect the presence of said yarn reserve (4) in the area close to a yarn inlet end of the drum (1).

* * * * *